US012274399B2

(12) United States Patent
Ludwig

(10) Patent No.: US 12,274,399 B2
(45) Date of Patent: Apr. 15, 2025

(54) REUSABLE TOILET PAPER SYSTEM

(71) Applicant: MyLifeLab, LLC, Sebastopol, CA (US)

(72) Inventor: Marcia Ludwig, Sebastopol, CA (US)

( * ) Notice: Subject to any disclaimer, the term of this patent is extended or adjusted under 35 U.S.C. 154(b) by 259 days.

(21) Appl. No.: 17/966,050

(22) Filed: Oct. 14, 2022

(65) Prior Publication Data

US 2024/0122416 A1 Apr. 18, 2024

(51) Int. Cl.
*A47K 10/28* (2006.01)

(52) U.S. Cl.
CPC ..... *A47K 10/28* (2013.01)

(58) Field of Classification Search
CPC ..... A47K 10/28
USPC ..... 312/34.5
See application file for complete search history.

(56) References Cited

U.S. PATENT DOCUMENTS 1,689,622 A * 10/1928 Clover ..... A47K 10/28 312/34.5
2,738,898 A * 3/1956 Lee ..... A47K 10/32 312/324
4,919,302 A * 4/1990 McPherson ..... A47K 10/421 229/120.08
6,332,551 B1 * 12/2001 Copeland ..... B65F 1/1623 220/823
6,508,383 B2 * 1/2003 Lidahl ..... E05B 1/0069 221/97
6,905,039 B2 * 6/2005 Richter ..... B65F 1/08 220/23.83
7,222,747 B1 * 5/2007 Savran ..... A47K 10/42 221/45
7,490,734 B2 * 2/2009 Carr ..... A47K 10/424 221/92
8,174,216 B2 * 5/2012 Lin ..... B65D 43/26 318/453
8,561,837 B2 * 10/2013 Giammanco ..... A47K 10/46 221/102
10,232,993 B2 * 3/2019 Seiders ..... A47G 19/2272
11,707,163 B2 * 7/2023 Masino ..... A47K 10/3827 221/45
11,858,734 B1 * 1/2024 Wang ..... B65F 1/06
11,945,646 B2 * 4/2024 McDonald ..... B65F 1/163
2009/0223991 A1 * 9/2009 Lorenzati ..... A47K 10/421 221/34
2009/0223992 A1 * 9/2009 Lorenzati ..... A47K 10/421 221/34
2011/0084089 A1 * 4/2011 Maccario ..... A47K 10/46 221/34

(Continued)

*Primary Examiner* — Daniel J Troy
*Assistant Examiner* — Timothy M Ayres
(74) *Attorney, Agent, or Firm* — My Patent Guys; Christopher Pilling

(57) ABSTRACT

A reusable toilet paper system is provided. The system includes a water reservoir configured to hold soiled cloth and storage container removably attached to the water reservoir configured to hold unsoiled cloth. A lid is hingedly attached to a top portion of the water reservoir, wherein the lid comprises an integrated drain and a drain closure element. The drain closure element is movable between a first position and a second position, the first position closes the integrated drain and the second position opens the integrated drain such that water from the water reservoir may be drained while the soiled cloth is retained within the water reservoir.

8 Claims, 9 Drawing Sheets

(56) References Cited

U.S. PATENT DOCUMENTS

| | | | | |
|---|---|---|---|---|
| 2011/0139781 | A1* | 6/2011 | Jin | B65F 1/1646<br>220/254.5 |
| 2015/0239664 | A1* | 8/2015 | Liistro | B65F 1/10<br>220/523 |
| 2018/0057257 | A1* | 3/2018 | Campbell | B65F 1/12 |

* cited by examiner

REUSABLE TOILET PAPER SYSTEM

CROSS-REFERENCE TO RELATED APPLICATIONS

N/A

BACKGROUND OF THE INVENTION

1. Field of the Invention

The present invention relates generally to hygiene but more particularly to a reusable toilet paper system.

2. Description of Related Art

The use of traditional paper toilet paper has significant implications to the environment from its waste and production. In the United States alone, approximately 40 billon rolls of toilet paper are used every year. In production, approximately 500 billion gallons of water is needed to produce the paper, and 300,000 tons of chlorine is needed to bleach the paper white. Further, electricity is needed for production, and the paper adds a significant load to city sewer systems and water treatment plants. The clear-cutting of carbon rich trees is also a concern as over 27,000 trees are cut down every single day just to make toilet paper.

Some manufactures have started to offer reusable toilet paper, however, currently no storage systems are available for both prior to use and after use of the reusable toilet paper. Consequently, a solution is provided.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In one aspect of the invention, a reusable toilet paper system is provided, comprising a water reservoir configured to hold soiled cloth; a storage container removably attached to the water reservoir configured to hold unsoiled cloth; a lid hingedly attached to a top portion of the water reservoir, wherein the lid comprises an integrated drain and a drain closure element; and, wherein the drain closure element is movable between a first position and a second position, the first position closes the integrated drain and the second position opens the integrated drain such that water from the water reservoir may be drained while the soiled cloth is retained within the water reservoir.

In one embodiment, the lid includes a gasket configured to create a watertight seal between the lid and the water reservoir. In one embodiment, the lid includes a handle. In one embodiment, the water reservoir is constructed from stainless steel. In one embodiment, the water reservoir has a base surface having a plurality of non-slip feet. In one embodiment, the water reservoir is taller than it is wide and deep providing a space saving design for tight spaces approximate to an existing toilet. In one embodiment, the water reservoir is semi cylindrical and/or rectangular. In one embodiment, the drain closure element is magnetic ensuring the drain closure element is secured in the first position and/or the second position. In one embodiment, the storage container removably attached to the water reservoir via a magnetic connection.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

Figure 1:
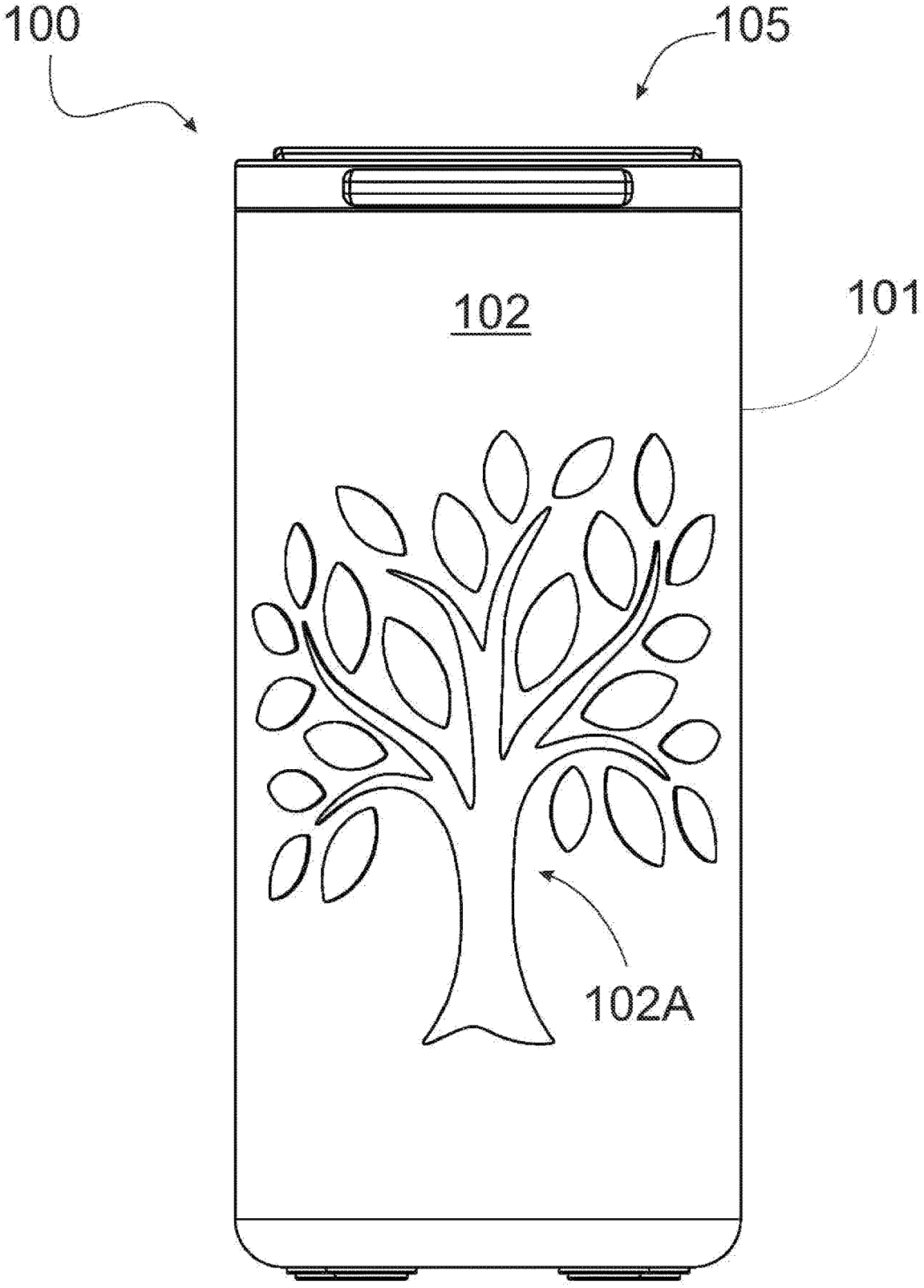
FIG. 1 is a front view of a reusable toilet paper system according to an embodiment of the present invention.
Figure 2:
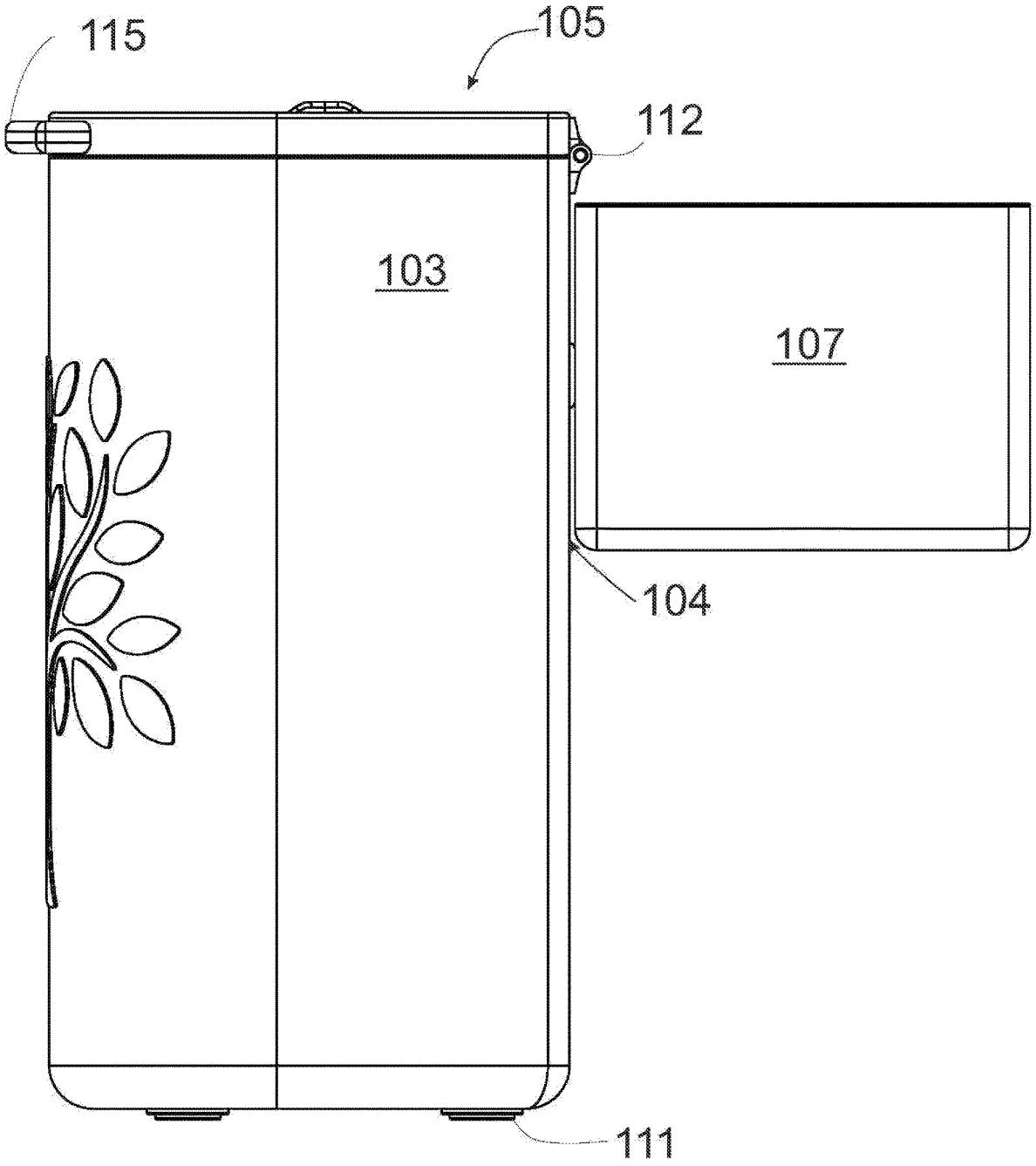
FIG. 2 is a side view of the reusable toilet paper system according to an embodiment of the present invention.
Figure 3:
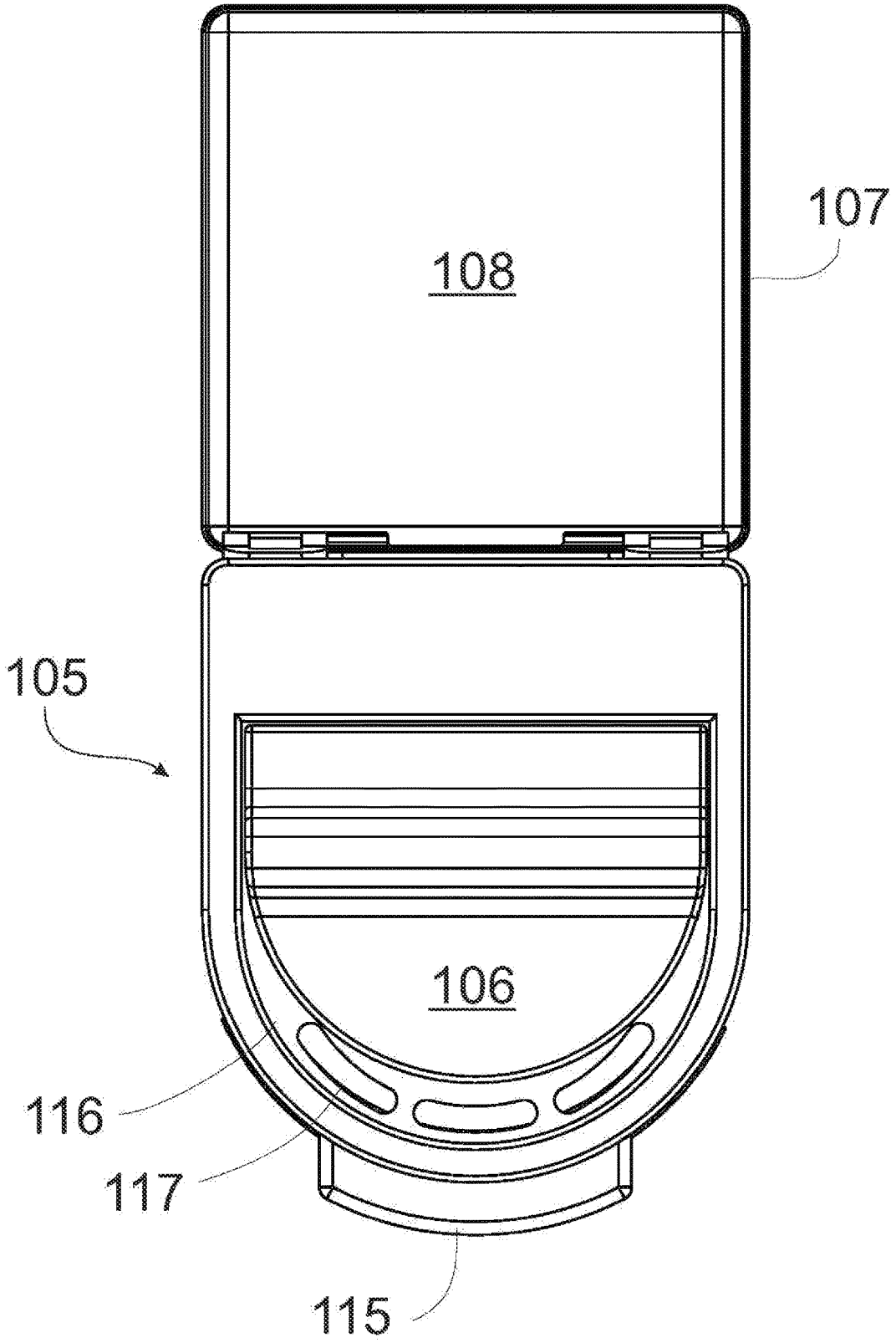
FIG. 3 is a top view of the reusable toilet paper system according to an embodiment of the present invention.
Figure 4:
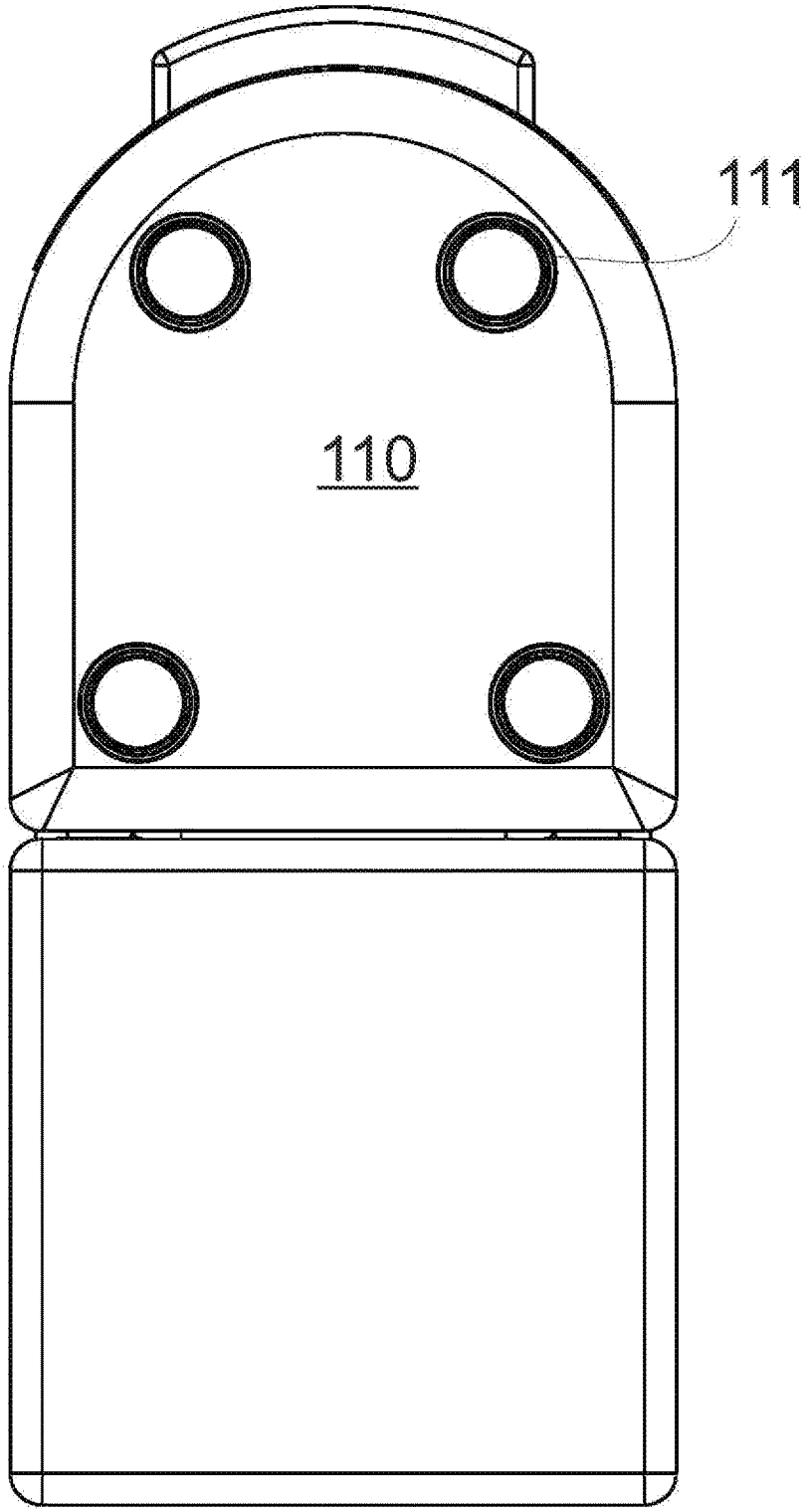
FIG. 4 is a bottom view of the reusable toilet paper system according to an embodiment of the present invention.
Figure 5:
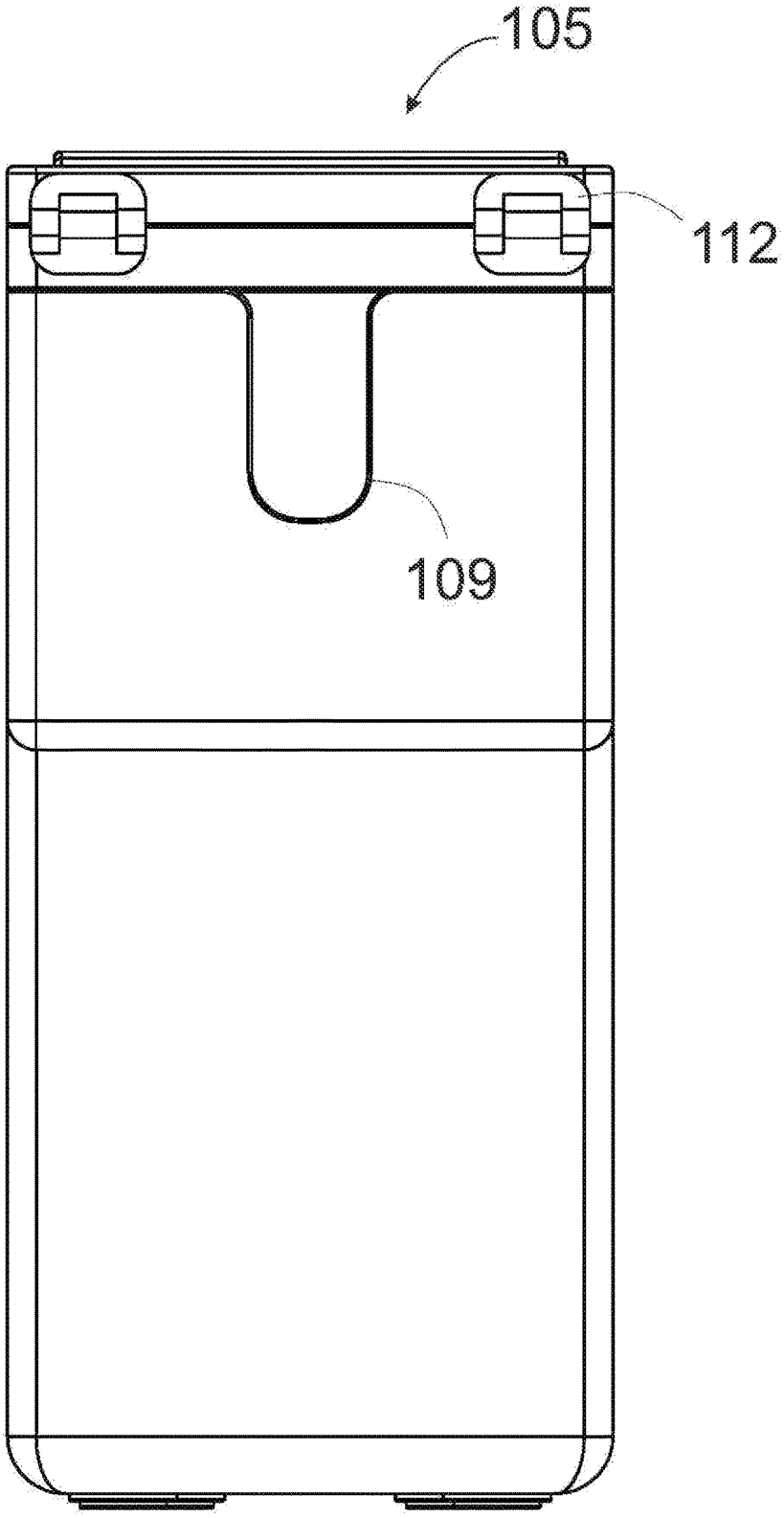
FIG. 5 is a rear view of the reusable toilet paper system according to an embodiment of the present invention.
Figure 6:
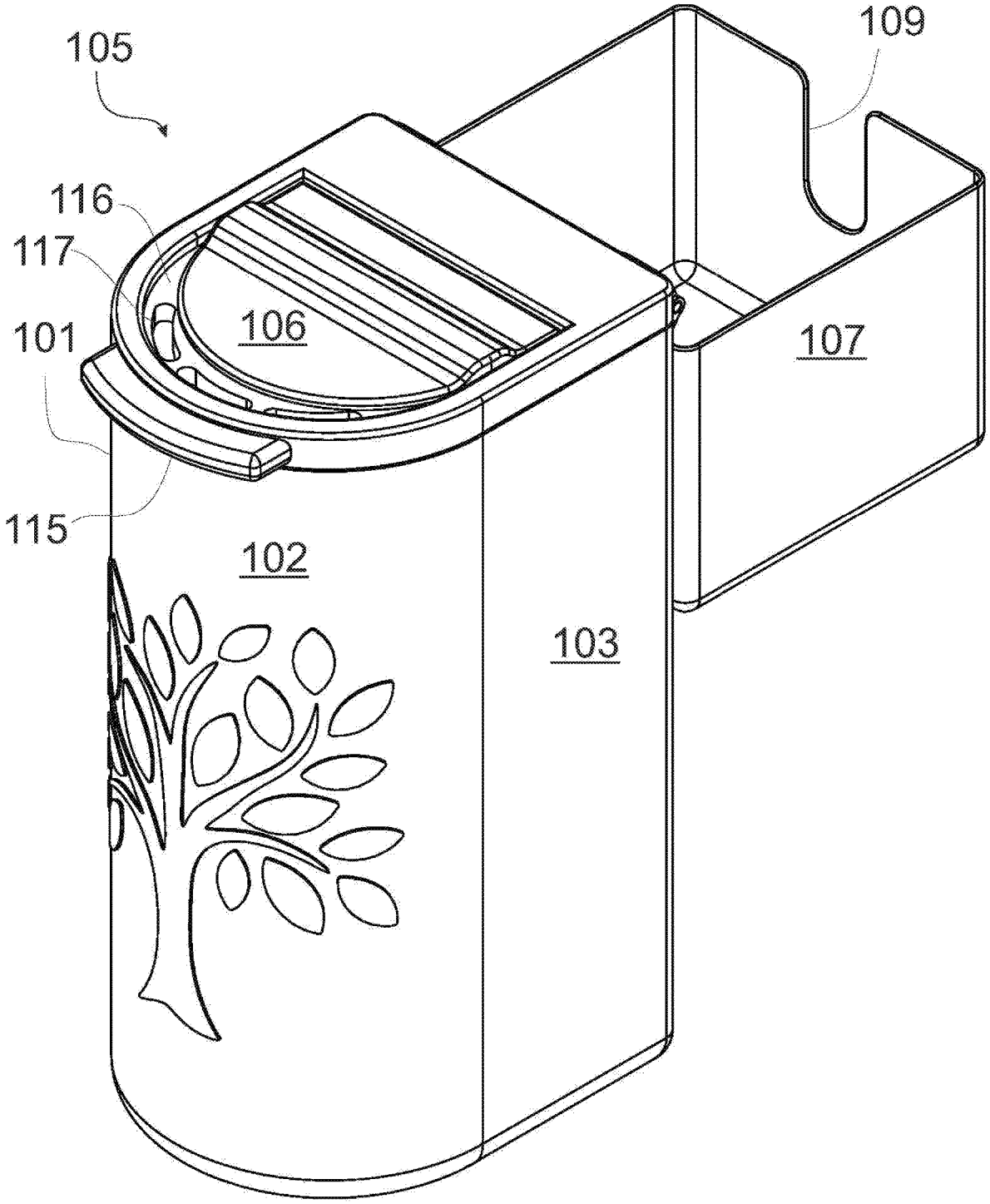
FIG. 6 is a perspective view of the reusable toilet paper system according to an embodiment of the present invention.
Figure 7:
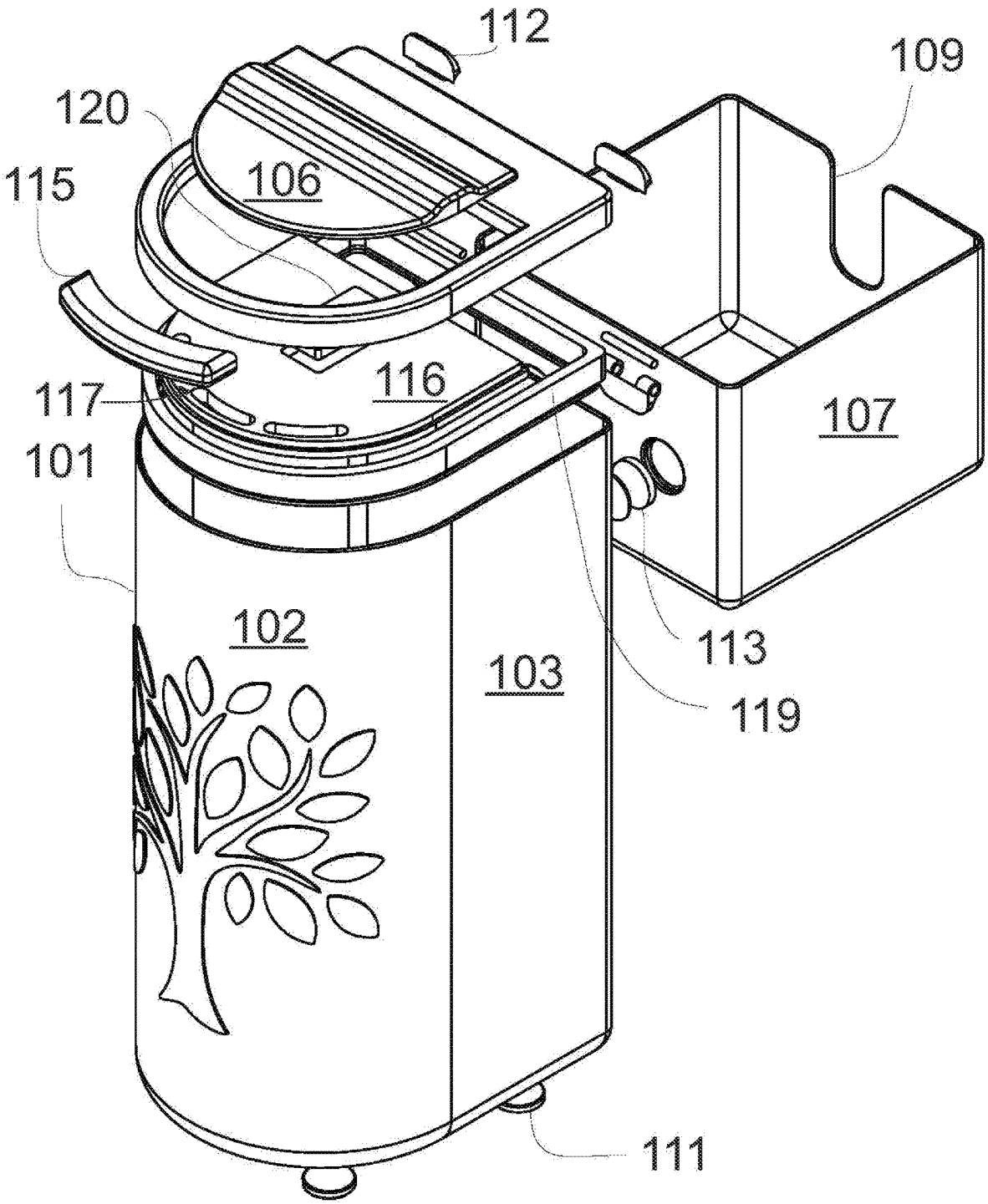
FIG. 7 is an exploded perspective view of the reusable toilet paper system according to an embodiment of the present invention.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a reusable toilet paper system.

It is to be understood that the terminology used herein is for the purpose of describing particular embodiments only and is not intended to be limiting. The terms "a" or "an," as used herein, are defined as to mean "at least one." The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanent. The term "providing" is defined herein in its broadest sense, e.g., bringing/coming into physical existence, making available, and/or supplying to someone or something, in whole or in multiple parts at once or over a period of time. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Referring now to any of the accompanying FIGS. 1-9, the reusable toilet paper system 100 is illustrated. In one embodiment, the reusable toilet paper system 100 comprises a reservoir 101 having a lid 105 sized and shaped to match the profile of the reservoir. In one embodiment, the reservoir is configured to hold at least a volume of water. In some embodiments, cleaning solutions, essential oils, or similar substances may be added to the volume of water. This will be discussed in further details below.

In one embodiment, the reservoir comprises a front surface 102, a pair of side surfaces 103, a rear surface 104, and a bottom or base surface 110. In some embodiments, the reservoir is constructed from stainless steel, and preferably brushed stainless steel. However, other materials may be utilized including but not limited to plastic, wood, aluminum, etc. The system may be constructed from any known methods, such as 3D printing, molding, forging, bending, etc. For design, one or more surfaces may include a powder epoxy finish with any color or design desired. In one embodiment, the front surface may include a design or branding 102A as well known in the art. In some embodiments, the bottom or base surface 110 includes a plurality of feet 111, preferably constructed of rubber or silicone to provide sufficient friction preventing the reservoir from slipping or moving during use.

In some embodiments, the reservoir 101 is rectangular in shape. In other embodiments, the reservoir 101 is cylindrical, semi-cylindrical, or a combination of rectangular and cylindrical (as illustrated). It should be understood that the shape of the reservoir may vary as long as it follows the following considerations: (a) a space saving slim design having a small footprint which is defined as a shape taller in height than either the width and or depth of the structure; (b) flat base 110 and/or feet 111 such that the reservoir is secure on the floor surface; and (c) having an interior volume to hold at least 5 quarts of liquid. Although it should be understood that the dimensions may vary, in one embodiment, the reservoir is approximately 11.75 inches tall, 5.25 inches wide, and 6 inches long. With the attached storage container and lid, which will be discussed below, the overall length is 11.81 inches long.

Figure 8A:
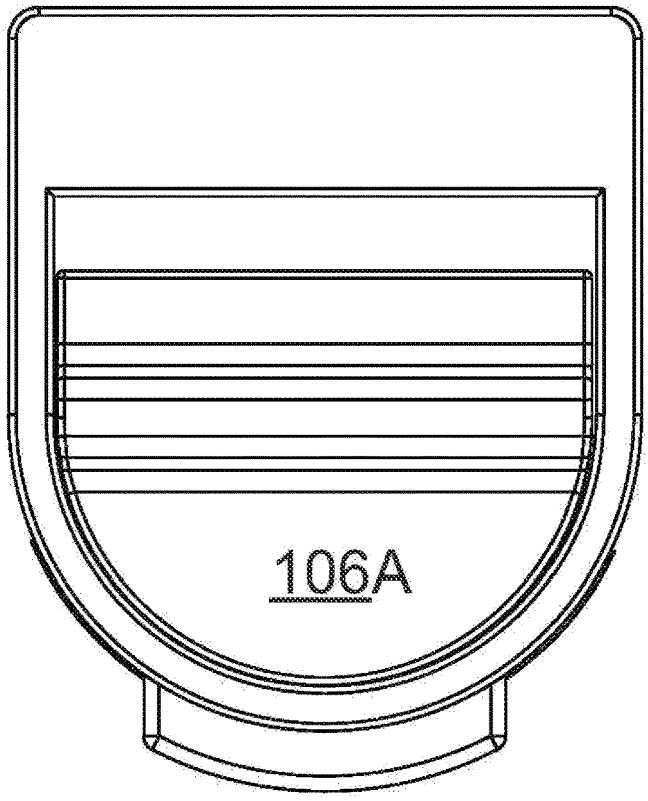
FIG. 8A shows the lid closure element in a first position according to an embodiment of the present invention.
Figure 8B:
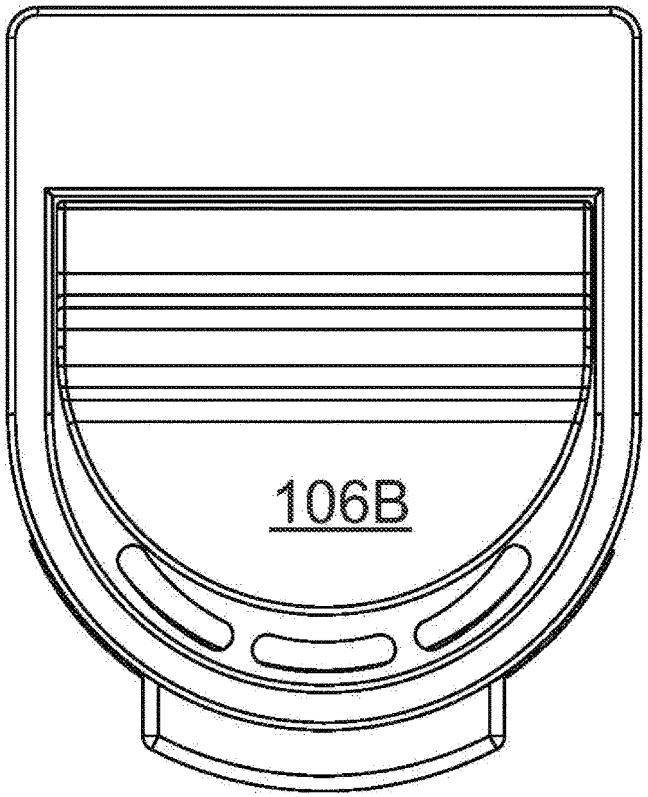
FIG. 8B shows the lid closure element in a first position according to an embodiment of the present invention.

Advantageously, the lid 105 is watertight on the reservoir 101 via gasket 119 which is sized and shaped to fit between the top portion of the reservoir and lid perimeter. In one embodiment, the gasket is affixed to the lid. In other embodiments, the gasket is affixed to the top portion of the reservoir. In some embodiments, the lid 105 comprises an integrated drain 116 having drain holes 117 positioned around the perimeter of the integrated drain 116. In one embodiment, the integrated drain is transparent. In some embodiments, the lid 105 further comprises a drain closure element 106 that is operable between a first position (106A; FIG. 8A) and a second position (106B; FIG. 8B), wherein the first position closes the integrated drain and the second position opens the integrated drain and more specifically exposes the drain holes 117 of the integrated drain 116. In some embodiments, magnets 120 are to facilitate a secure transition from the first to the second position or vice versa. In this embodiment, the drain closure element 106 is constructed from a magnetic material or comprised of magnets and constructed from a non-magnetic material. Magnets may be positioned in any location to efficiently operate the locking and operation of the drain closure element 106. Advantageously, the integrated drain 116 and specifically the drain holes 117 enable water from the water reservoir to be drained while the soiled cloth is retained within the water reservoir during use as the cloth is larger than the drain holes. This will be discussed in further details below.

Figure 9:
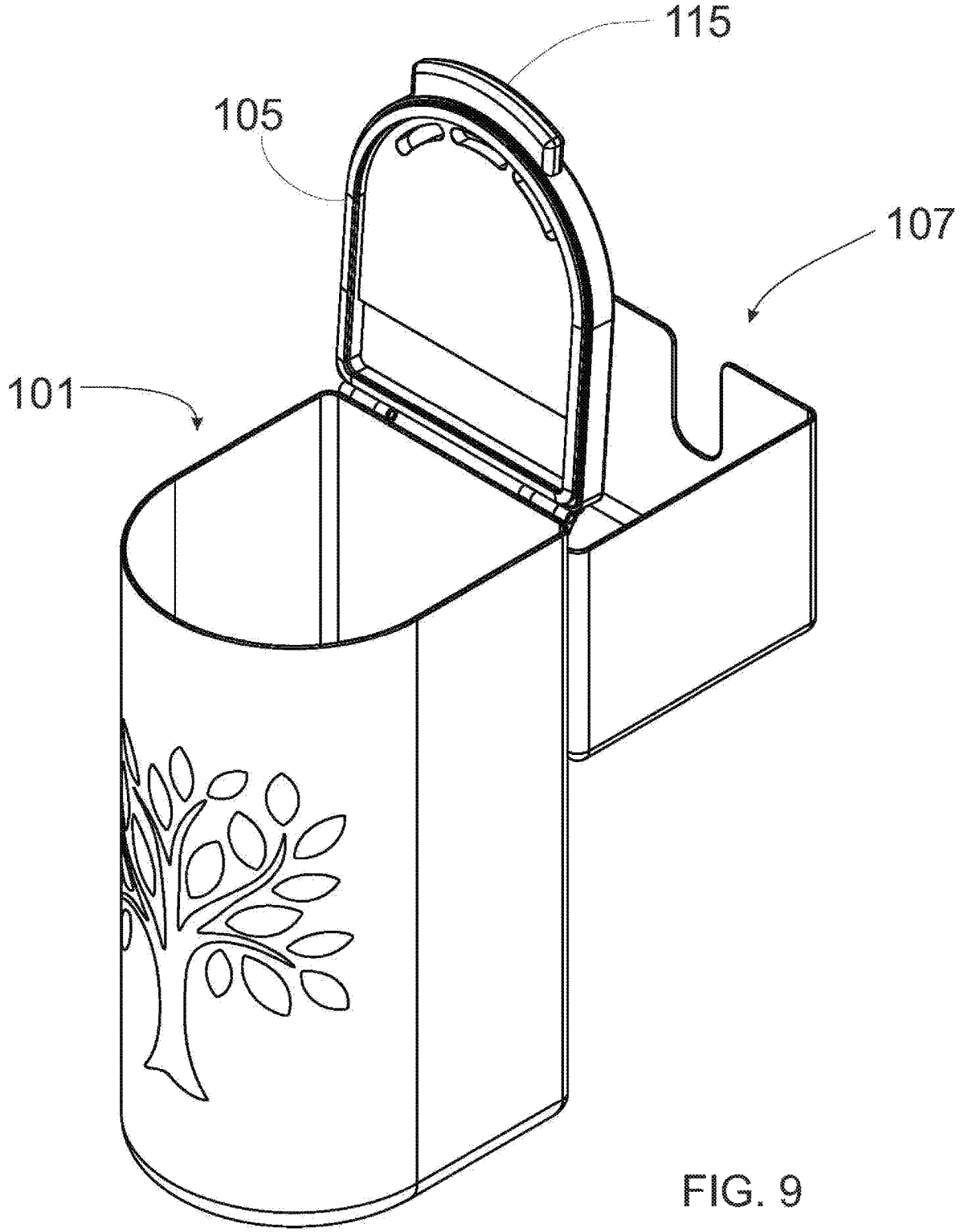
FIG. 9 shows the lid in an opened position according to an embodiment of the present invention.

In some embodiments, the lid 105 includes a lid handle 115 to facilitate the opening and closing of the lid 105, which enables complete access to the inner volume of the reservoir 101. This enables the user to fill the reservoir and access the soiled cloth for laundering. In some embodiments, the lid 105 is rotatable up to 180 degrees via hinge 112. Preferably, a sleek minimal style hinge is used to reduce space and improve appearance; however any hinge may be used as known in the art. FIG. 9 shows the lid in an open position exposing the internal volume of the reservoir 101. It should be noted that the lid's full range of motion is enabled to rotate completely over the storage container 107.

In some embodiments, magnets, magnetic material, or other attachment method is provided on the rear surface 104 of the reservoir 101 to allow for a connection of a storage container 107 via magnets 113 positioned on the adjoining surface of the storage container 107. The storage container 107 is intended to store unsoiled cloth for use. The cloth may be cloth wipes, cloth material sections, or similar. The attachment method enables the storage container 107 to be removably attached to the reservoir 101. In one embodiment, the storage container 107 is square in shape and is positioned toward the upper end or top portion of the reservoir such that the storage container 107 is easily accessible during use. In other embodiments, the storage container 107 is rectangular in shape. In some embodiments, the cloth material section are square shaped and sized to fit within the square storage container 107. The internal volume 108 of the storage container 107 is adequately sized to store enough cloth for multiple uses. In some embodiments, a U-shaped cutout 109 is provided on a rear portion of the storage container 107 enabling the cloth to be removed from the storage container efficiently.

The following is a best mode method for using the system of the present invention, however it should be understood that other methods of use are available without departing from the spirit and scope of the present invention. First, the reservoir should be filled with an adequate volume of water based on the capacity of the internal volume. In one embodiment, the adequate volume of water is 5 quarts. The adequate volume of water is such that the soiled cloth material sections or wipes can efficiently soak in the reservoir prior to washing without risk of overflowing. This volume may vary based on individual preferences, weight considerations, water conservation efforts, etc. As previously discussed, cleaning solutions, essential oils, or similar may be added to the volume of water, which may help clean, soak, or treat the cloth prior to washing. Additionally, the additives are configured to help mask or improve any fragrances or smells from the reservoir. Second, unsoiled cloth material sections or wipes are placed in the storage container. In this step, the storage container may be removed from the reservoir and reattached via the magnetic attachment feature if desired. Next, if not already done so, the system should be positioned approximate to the user's toilet. Now the system is ready for use. During use, the cloth is used as a replacement for toilet paper as known in the art. After each cloth wipe or material section is used, the user places the soiled cloth within the reservoir. In this step, the lid may be opened to expose the inner volume of the reservoir prior to use, or opened as needed by use of the lid handle during use. After the user is satisfied using one or more cloth wipes, the lid is closed if not already done so. This process repeats until the reservoir is full or the cloth storage container needs to be replenished. The next phase is the maintenance phase to get the system ready for use again. During this phase, the drain closure element 106 is moved to the second position exposing the integrated drain 116 and drain holes 117. Then, the user may drain the reservoir into a drain, toilet, etc. leaving the soiled cloth within the reservoir, which can now be laundered as desired by the user, e.g. emptied in the washing machine. Advantageously, this process also prevents the requirement for handling the soiled cloth directly. Finally, the reservoir may be cleaned as desired and refilled for use as previously described.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A reusable cloth toilet paper system comprising:

a water reservoir having a first surface, a pair of side surfaces, a bottom surface, and a rear surface, wherein the water reservoir having an interior volume configured to hold liquid and soiled cloth, wherein the bottom surface is configured to rest on a ground surface;

a storage container removably attached to the rear surface of the water reservoir, the storage container suspended above the ground surface and positioned adjacent to a top portion of the water reservoir, wherein the storage container is configured to hold unsoiled cloth;

a watertight lid hingedly attached to a top portion of the water reservoir, wherein the watertight lid comprises an integrated drain having a plurality of drain holes positioned around a perimeter of the integrated drain, wherein the integrated drain is recessed within the watertight lid; and a drain closure element, wherein the drain closure element is movable between a first position and a second position within the integrated drain recess, the first position closes the integrated drain and the second position opens the integrated drain to expose the plurality of drain holes such that water from the water reservoir may be drained while the soiled cloth is retained within the water reservoir, wherein the drain closure element is movable independent of the watertight lid such that the lid may be closed when the integrated drain is in the second position.

2. The reusable cloth toilet paper system of claim 1, wherein the watertight lid includes a gasket configured to create a watertight seal between the watertight lid and the water reservoir.

3. The reusable cloth toilet paper system of claim 1, wherein the water reservoir is constructed from a strong waterproof material.

4. The reusable cloth toilet paper system of claim 1, wherein the bottom surface includes a plurality of non-slip feet.

5. The reusable toilet cloth paper system of claim 1, wherein the water reservoir is taller than it is wide and deep providing a space saving design for tight spaces approximate to an existing toilet.

6. The reusable toilet cloth paper system of claim 1, wherein the water reservoir is semi cylindrical and/or rectangular.

7. The reusable cloth toilet paper system of claim 1, wherein the drain closure element is magnetic ensuring the drain closure element is secured in the first position and/or the second position.

8. The reusable cloth toilet paper system of claim 1, wherein the water reservoir is approximately 11.75 inches tall, 5.25 inches wide, and 6 inches long.

* * * * *